US005400540A

United States Patent [19]

Solinsky et al.

[11] Patent Number: 5,400,540

[45] Date of Patent: Mar. 28, 1995

[54] AIMING LIGHT AND MOUNTING ASSEMBLY THEREFOR

[75] Inventors: Kenneth S. Solinsky; Matt S. Magoun, both of Bedford; William D. Leary, Jr.; Richard H. Cartier, both of Bow; Wallace E. Woodman, III, Richfield; Vadim Plotsker, Bedford, all of N.H.

[73] Assignee: Insight Technology Incorporated, Londonderry, N.H.

[21] Appl. No.: 957,916

[22] Filed: Oct. 8, 1992

[51] Int. Cl.[6] ..... F41G 1/35

[52] U.S. Cl. ..... 42/103; 362/110

[58] Field of Search ..... 42/103, 100; 33/241, 33/261; 362/110

[56] References Cited

U.S. PATENT DOCUMENTS

| | | | |
|---|---|---|---|
| 933,095 | 9/1909 | Mostellev | 42/103 |
| 1,057,518 | 4/1913 | Ancher . | |
| 1,865,127 | 6/1937 | McKeen . | |
| 2,095,732 | 7/1937 | Baxter et al. | 42/103 |
| 2,158,915 | 5/1939 | Searcy . | |
| 2,385,649 | 9/1945 | Prideaux | 42/100 |
| 2,529,057 | 11/1950 | Teffault . | |
| 2,546,242 | 3/1951 | Stinson . | |
| 2,597,565 | 5/1952 | Chandler et al. . | |
| 3,742,636 | 7/1973 | Dealy et al. . | |
| 4,069,414 | 1/1978 | Bell | 42/103 |
| 4,281,993 | 8/1981 | Shaw | 33/241 |
| 4,295,289 | 10/1981 | Snyder | 42/103 |
| 4,554,744 | 11/1985 | Huckenbeck | 33/241 |
| 4,638,139 | 4/1987 | Brennan et al. | 33/241 |
| 4,665,622 | 5/1987 | Idan | 33/241 |
| 4,697,226 | 9/1987 | Verdin | 42/103 |
| 4,876,815 | 10/1989 | Terrill | 42/101 |
| 4,876,816 | 10/1989 | Triplett | 42/103 |
| 4,905,396 | 3/1990 | Bechtel | 42/101 |
| 4,926,576 | 5/1990 | Marg | 42/103 |
| 5,064,988 | 11/1991 | E'nawa et al. | 42/103 |

FOREIGN PATENT DOCUMENTS

| | | | |
|---|---|---|---|
| 2592149 | 6/1987 | France | 42/100 |
| 2052025 | 1/1981 | United Kingdom | 42/103 |

*Primary Examiner*—Stephen M. Johnson
*Attorney, Agent, or Firm*—Baker & Botts

[57] ABSTRACT

A novel aiming light assembly and mounting bracket therefor is disclosed. The bracket has a first portion which clamps to the barrel of a weapon, a second portion including a cut-out which fits over and abuts against the front sight post of the weapon, and a third portion on which the aiming light assembly is mounted. A novel switching assembly and the combination of integral and remote switching is provided. An improved steering mechanism is provided to facilitate boresighting of the aiming light assembly once mounted on weapon.

6 Claims, 6 Drawing Sheets

AIMING LIGHT AND MOUNTING ASSEMBLY THEREFOR

FIELD OF THE INVENTION

The invention relates generally to aiming lights and mounting assemblies for use therewith.

BACKGROUND OF THE INVENTION

In general, aiming lights which are used to assist in aiming a weapon are well known. One known type of aiming light is an infrared aiming light. One such device which is available to the military is referred to as the AN/PAQ-4A provided by Insight Technology, the assignee of the present invention. Commercially available models include the IRAD 350 ES, the IRAD 2500 and other similar devices. The AN/PAQ-4A provides a rapid, accurate aim point for a user of a weapon at night. The AN/PAQ-4A accomplishes these objectives by projecting a highly collimated beam of pulsating IR energy which is invisible to the naked eye, but which is readily seen with night vision goggles. Once boresighted to a weapon, the operator simply puts the infrared aiming light beam on the target and fires.

Several factors are important to enable an aiming light to be easily and efficiently used. These factors include, but are not limited to, the location of the aiming light on a weapon, the ease and stability with which the aiming light may be mounted to a weapon, the ease with which the aiming light may be boresighted to the weapon and the ease with which the aiming light may be switched on and off. Other factors which are important include the vulnerability of the aiming light due to undesired impact, providing an aiming light which does not interfere with normal sighting, the ability to use an aiming light on a variety of different types of weapons and the minimization of detrimental effects caused by providing the aiming light on a weapon. These detrimental effects include the inability to use an aiming light in combination with an accessory such as a bayonet and/or a grenade launcher on the weapon and the propensity of the aiming light to snag foliage or the like if the aiming light extends from a side of the weapon, for example. Other considerations are also important. For example, the convenience with which the device can be mounted, the convenience of operation and the system reliability are also important. The use of an integral switch is beneficial in these areas since it requires only a single mounting and there are no exposed wires or cables which can get tangled or torn off. Provision for a remote switch extends flexibility of the aiming light for mounting on weapons where an integral switch can not be conveniently accessed. Prior art aiming lights have drawbacks in many of these areas.

SUMMARY OF THE INVENTION

It is an object of the present invention to overcome these and other drawbacks of the prior art. Specifically, it is an object of the invention to provide an improved aiming light and mounting assembly therefor.

It is another object of the invention to provide a novel mounting bracket for mounting an aiming light to a weapon.

It is another object of the invention to provide a novel switching assembly for an aiming light.

It is another object of the invention to provide an aiming light which may be controlled by a remote control switch and by an integral switch associated with the aiming light assembly.

It is another aspect of the invention to provide improved structure for boresighting an aiming light mounted to a weapon.

In order to accomplish these and other objects of the present invention, there is provided a new and improved aiming light assembly and mounting structure therefor. Preferably, the aiming light is mounted on top of and substantially centered on the weapon behind a front sight post thereof. Preferably the aiming light assembly is designed to enable placement in this location without interfering with normal sighting using the front and rear sight posts. Preferably, the assembly abuts against the front sight post and is substantially contained within the envelope of the weapon. In order to facilitate the mounting of the aiming light assembly in this position, preferably, a novel mounting bracket assembly is provided. The mounting bracket assembly includes a first portion which is attachable to the barrel of the weapon, a second portion having a cut-out which fits over the front sight post of the weapon and which abuts thereagainst to assist in preventing rotation of the aiming light, and a third section having an extension or tail upon which the aiming light may be easily mounted. Preferably, the design is such that an accessory (e.g. a bayonet or grenade launcher) may be mounted to the weapon in such a manner that this does not interfere with the aiming light assembly mounting and vice versa.

According to one embodiment, the mounting bracket, is designed to enable the aiming light assembly to be mounted on top of or on a side of a weapon. Another novel aspect of the invention is that a mounting foot can be used to mimic existing devices so that the unit can be mounted to existing brackets. By use of a female dove-tail in the bottom of an assembly and a mounting foot that is symmetrical, the aiming light assembly is easier to install, especially in the dark, for example.

In order to enable the aiming light assembly to be easily switched on and off, even when used with various types of weapons having various different configurations, there is provided a novel switching assembly for activating/deactivating the aiming light. The switching assembly has a manual integral switch which has five positions. The five positions include a first off position, a momentary on position, a steady on position, a second momentary on position, and a second off position. One advantage of this arrangement is the versatility it enables in mounting the assembly to different weapons.

Another novel feature of the switching of the aiming light assembly is that in addition to the integral switch provided on the aiming light assembly itself, there is provided an input receptacle (or jack) located on the aiming light assembly for receiving a cable (or other type of connector) to enable remote control switching of the aiming light. This combination of remote control switching and integral switching provides greater versatility by enabling convenient switching of the aiming light regardless of where the aiming light is mounted on a weapon.

In order to align the beam with the target area of the weapon to which the aiming light assembly is mounted (i.e., boresighting), two independent adjustment mechanisms are provided integrally with the aiming light assembly and are used to position or steer the aiming beam in the horizontal (azimuth) and vertical (elevation) directions. The integral, adjustment mechanism includes an external knob and an internal steering mechanism. Preferably, the external knob is capable of substantially only rotational movement with respect to the housing (e.g. it does not screw in and out) and the rotation of this knob causes the internal steering mechanism to adjust the aiming beam direction. This is preferable to moving the entire aiming light assembly relative to its mounting surface as is done in some prior art devices. It is also preferable to an adjustment mechanism which screws in and out relative to the aiming light body. This adjustment mechanism is more easily made waterproof and prevents dirt or other undesired particles from entering the aiming light assembly. This, among other things, improves system reliability. Additionally, a clicking mechanism may be built into the boresighting mechanism to enable the number of clicks (audible and/or tactile) to be measured to easily and repeatedly boresight the aiming light for varying target distances.

DETAILED DESCRIPTION OF THE PREFERRED EMBODIMENTS

With reference to the accompanying drawings, a detailed description of the preferred embodiments of the present invention will now be provided. It is to be understood however, that this explanation is by way of example only. The invention is not limited to the particulars of these drawings.

Figure 1:
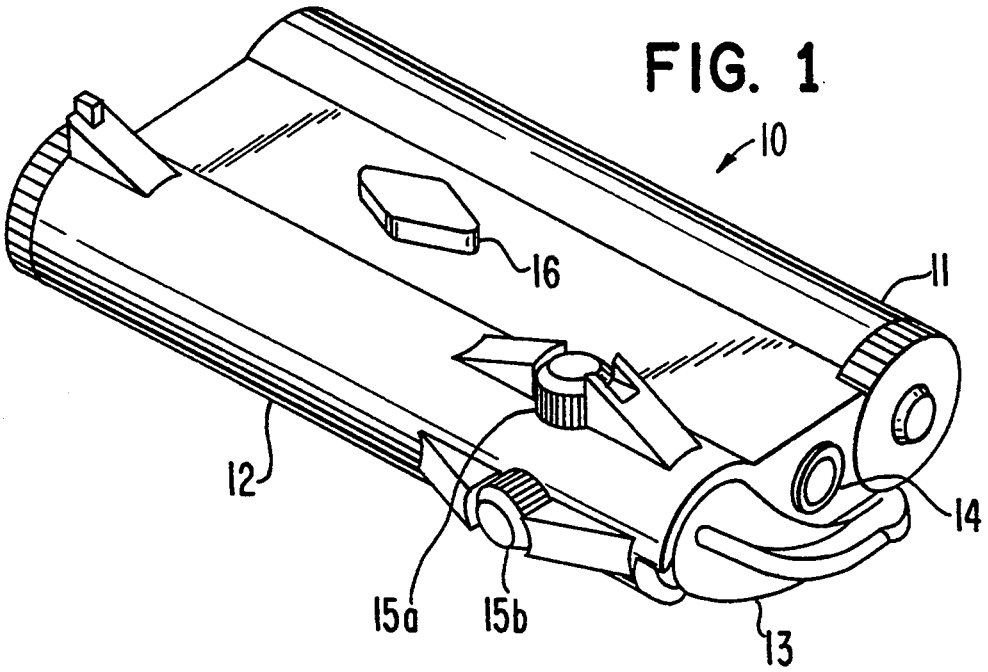
FIG. 1 is a perspective view of an aiming light assembly according to one embodiment of the present invention.

With reference to FIG. 1, an aiming light assembly according to a preferred embodiment of the present invention is shown and is generally designated by reference numeral 10. The aiming light assembly 10 comprises a housing (preferably a sealed plastic housing) which comprises a battery compartment 11 and an aiming light compartment 12 which are both located within the common housing. A switch lever 13 which activates a switch which controls the aiming light is provided integrally with the housing to enable selective activation and deactivation of the aiming light. Additionally, an input receptacle or jack 14 may be provided to enable remote control switching of the aiming light if desired. Adjustment knobs **15*a* and 15*b* are also provided to enable adjustment of the aiming light in the horizontal (azimuth) and vertical (elevation) directions as described more fully below. A fastening device 16, for example a thumb screw, is provided through openings (not shown in FIG. 1) in the housing to enable the assembly 10** to be mounted to a weapon. This general configuration enables the aiming light assembly to be compact (in both height and width). One advantage of this compact assembly is that the normal sighting through front and rear sight posts is not interfered with. Other advantages are also achieved (some of which are discussed herein) as will be readily apparent to one of ordinary skill in the art.

Figure 1A:
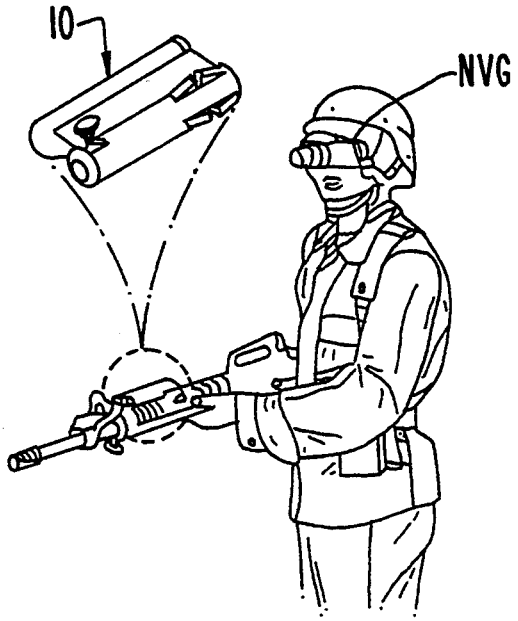
FIG. 1A is a diagrammatic view of an aiming light assembly mounted to an M-16 rifle according to one embodiment of the present invention.

The general operation of the aiming light is well known to one of ordinary skill in the art. Simply put, once the aiming light assembly 10 is mounted to a weapon and properly boresighted, activation of the switch lever 13 (or a remote switch connected through input jack 14) causes selective activation of the aiming light to cause a light beam to be projected at the target area of the weapon. If an infrared aiming beam is used, night vision goggles (NVG) are used to detect the aiming beam, as shown, for example, in FIG. 1A. Once the aiming light beam is located on the desired target, the weapon is fired and the ammunition hits the target.

Figure 1B:
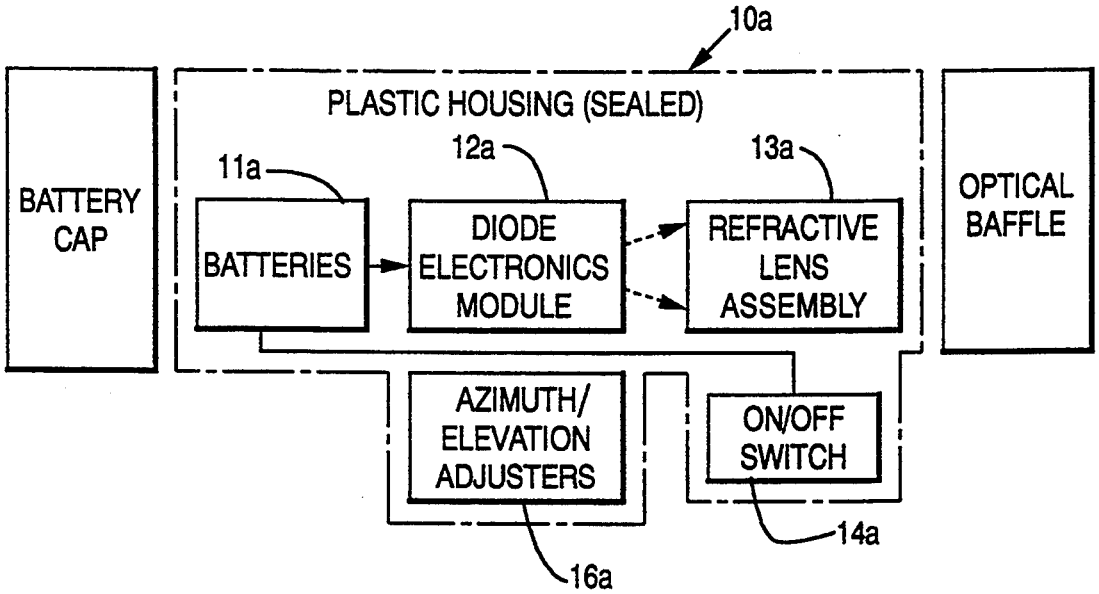
FIG. 1B is a functional block diagram of an aiming light assembly according to one embodiment of the present invention.

A functional block diagram of an aiming light assembly according to a preferred embodiment is shown in FIG. 1B. As shown, a sealed plastic housing **10*a* is provided and includes batteries 11*a* an electronics assembly located within a housing 12*a*, an optical assembly located within a housing 13*a*, an on/off switch 14*a*, azimuth/elevation adjusters 16*a***, a battery cap and an optical baffle. The general operation of these components will be readily apparent to one of ordinary skill in the art.

Figure 2:
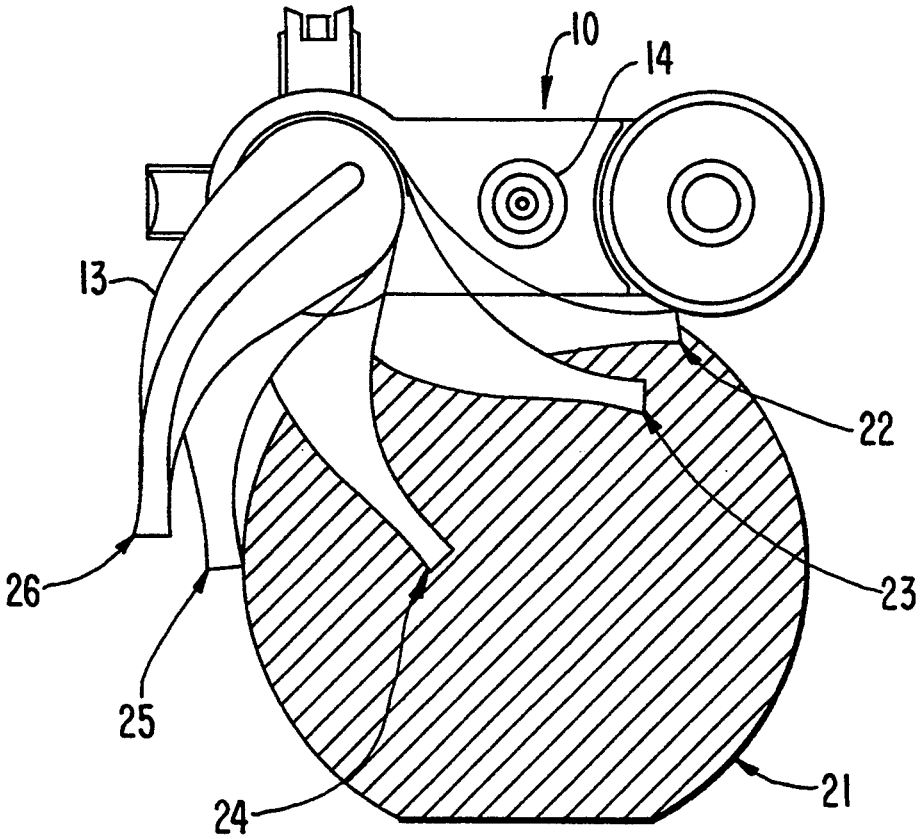
FIG. 2 is a schematic illustration of the switch positions according to one embodiment of the present invention.

According to one aspect of the invention, the integral switch preferably comprises a multi-position switch. Specifically, the switch is preferably operable in a plurality of positions as shown for example by the position of the switch lever 13 in FIG. 2. As shown in FIG. 2, switch lever 13 is operable in a plurality of positions. A first position 22 corresponds to an off position for the switch. In this position, the aiming light is off. When switch lever 13 is in a second position 23, this corresponds to a momentary on position for the switch. This position causes the aiming light to be on so long as the user maintains pressure on the switch lever 13. Upon release of the switch, the switch lever 13 automatically returns to the off position 22 due to a spring return mechanism. When the switch lever 13 is in a third position 24, this corresponds to a steady on position for the switch. In this position, the aiming light is on regardless of whether the user maintains pressure on the switch lever 13. A detent holds the switch lever in this position. A second momentary on position 25 and a second off position 26 are also provided and operate in a manner similar to the operation described above in connection with the momentary on position 23 and the off position 22. Upon release of the switch lever 13 at position 25, a spring mechanism causes the switch to return to off position 26. By providing the redundant off and momentary on positions greater versatility is achieved by the aiming light assembly and the aiming light assembly 10 may be conveniently used with a wide variety of weapons having different configurations. For example, when aiming light assembly 10 is mounted on an M16A1/A2/A3 rifle or an M4 carbine, for example, the switch lever is moved to the OFF position 26 before installation. The Momentary ON position 25 activates the aiming light, and the weapon handguard 21 prevents moving the switch lever to the Steady On position 24. In this way, the aiming light will not be inadvertently left on while mounted on the rifle or carbine. For use on the M16/M203 and M249, M249A1, the aiming light is mounted with the switch lever in OFF Position 22, and is activated in the Momentary ON Position 23. For use on other weapons such as the M2 or M60 machine guns, the lever may be pressed from Off Position 22 to the Steady On position 24, where it is held by a detent for continuous use.

Figure 2A:
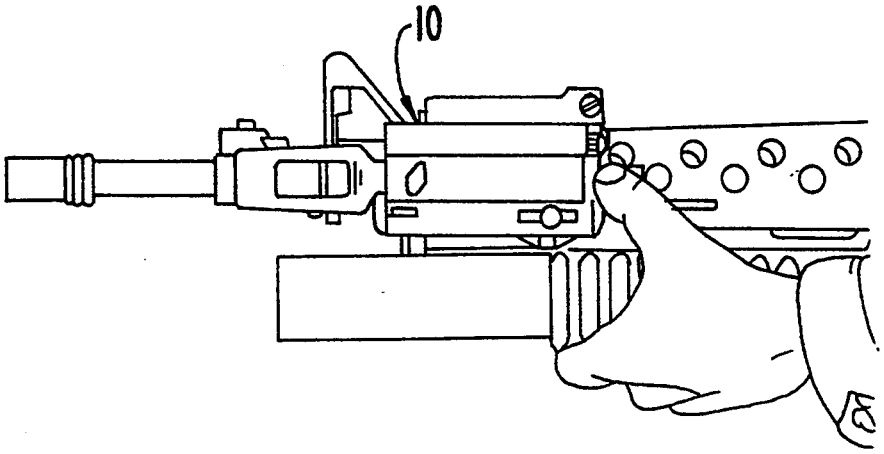
FIG. 2A is a schematic illustration of the aiming light assembly according to one embodiment of the present invention mounted to the side of an M-16 with an M-203 grenade launcher attached thereto.
Figure 2B:
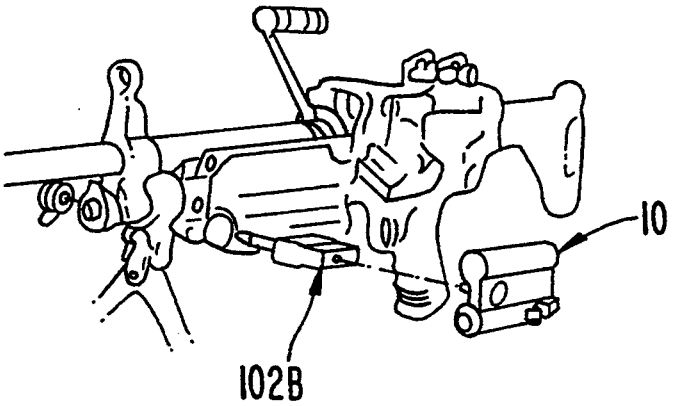
FIG. 2B is a schematic illustration of the aiming light assembly according to one embodiment of the present invention mounted to the side of an M-249.

On an M-16 rifle with an M-203 grenade launcher attached, for example, the aiming light assembly 10 may be mounted on the side of the weapon (i.e. rotated 90° with respect to the previously described position) as shown for example in FIG. 2A. In this case, the switch lever 13 may be operable in a normally off position (position 22 in FIG. 2) and when pressed against the handguard, moves to position 23 where the aiming light is on until pressure is released and the switch lever 13 springs back to position 22. Similarly, as shown in FIG. 2B, for example, on an M-249 rifle, the aiming light can be mounted beside the handguard and the switch is operable between positions 22 and 23.

Additionally, at other times, the switch lever may be folded against the aiming light assembly 10 for compact carry and storage. In some cases, not all of the five positions are achievable. For example, when the aiming light assembly according to one embodiment of present invention is mounted on an M-16 rifle, for example, the switch lever 13 may be operable only in either the momentary on or the off position. In this case, the lever 13 may be prevented from further travel due to the switch lever 13 abutting against the handguard 21. In this case, the momentary on position may correspond to a position where the lever 13 touches against the handguard 21. However, according to one embodiment of the present invention, when the aiming light assembly is mounted to other types of weapons, or is used with other types of mounting brackets, all five positions or a plurality of positions may be usable. One important feature of this aspect of this invention is that it enables a single aiming light assembly to be mounted on a variety of different weapons without having to modify the aiming light switching assembly. It can also be used with a variety of types of mounting brackets.

Figure 1C:
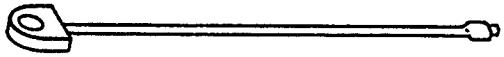
FIG. 1C is an example of a connector and remote switch which may be used in connection with the present invention.

Additionally, it is desirable to enable the switch to be easily operated, regardless of where the aiming light is mounted on the weapon. If the aiming light is mounted on or near the barrel of the weapon, the user may desire to activate the light with the integral switch. This could be conveniently done with a hand that is being used to support the front of the weapon in a normal firing position. Similarly, if the aiming light assembly is mounted back near the trigger assembly, a user could use the switch lever 13 to conveniently activate the aiming light assembly with the hand that is on the trigger assembly. However, if the aiming light assembly is mounted near the middle of the weapon, or if it is otherwise in a location that is not in convenient proximity to a user's hand(s) during normal handling of the weapon, it is desirable that a remote aiming switch be provided. To this end, jack 14 is provided so that a connector (e.g., a cable) which is connected to a remote switching device can be used to operate the aiming light assembly. Preferably, the remote switching device is selectively mounted (temporarily or permanently) near a location convenient to the user during normal operation of the weapon. This feature enables the aiming light assembly to be used with a wide variety of weapons having a variety of different geometries and configurations and enables the assembly to be mounted at various locations. The remote switch may be an on/off switch or a momentary on, normally off switch. An example of a remote switch 101 and connector 102 (e.g. a cable or wire) is shown in FIG. 1C.

Figure 3:
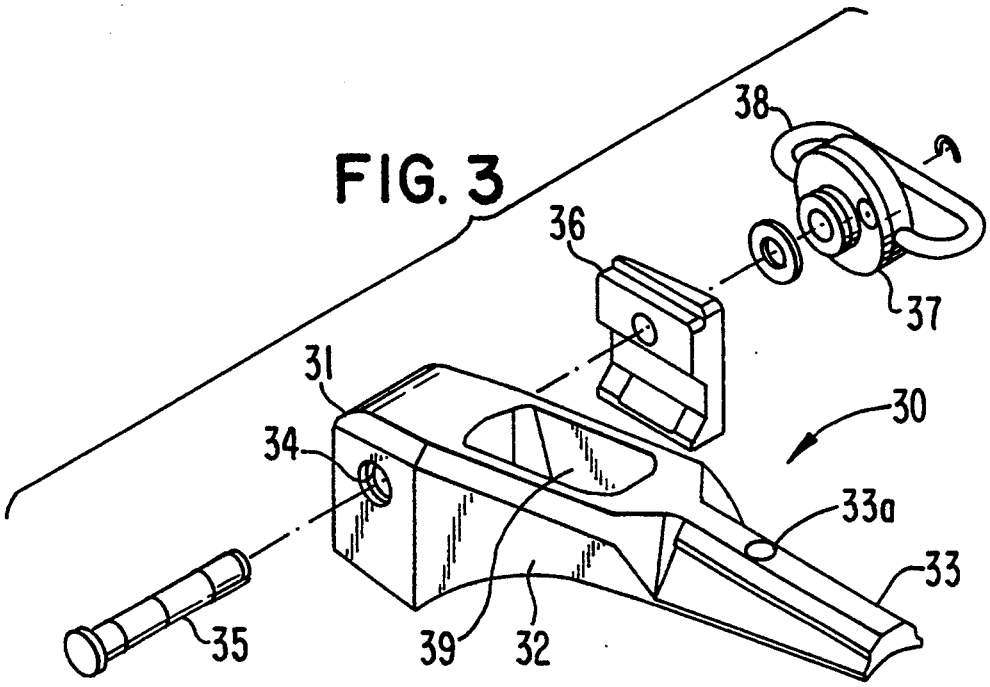
FIG. 3 is an exploded schematic of a mounting bracket assembly according to one embodiment of the present invention.
Figure 3A:
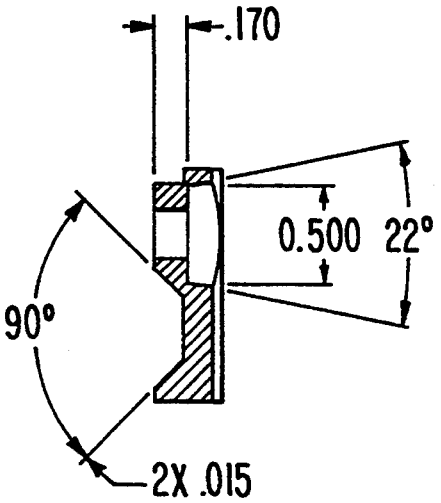
FIG. 3A is an example of a clamp which may be used with the present invention.

For a variety of reasons, some of which are discussed herein, it may be preferable to mount the aiming light assembly on a weapon (such as an M-16) on top of, substantially centered on and/or abutting against a front sight post of the weapon. In order to facilitate the mounting of the aiming light assembly in this (or these) position(s), a novel mounting bracket is provided. As shown for example in FIG. 3, there may be provided a mounting bracket which is generally indicated as 30 and which comprises a first portion 31, a second portion 32 and a third portion 33. The first portion 31 comprises a bracket which may be mounted to the barrel of the weapon. An opening 34 is provided through the bracket portion 31 to receive a pin or other suitable device 35. Device 35 passes through the portion 31 and is received by a bracket 36 and a latch 37 which preferably has a handle 38. The surfaces of portions 31 and 36 are contoured to provide firm contact with the barrel of a weapon (e.g., a M-16) when the bracket is clamped to the barrel. Clamping structures, in general, are well known. An example of the contour and shape of a clamping mechanism which is preferably used according to a preferred embodiment is shown in FIG. 3A. However, the invention is not so limited. Any suitable clamping mechanism may be used.

Portion 32 preferably connects portions 31 and 33 and is provided with a cutout portion 39 which is dimensioned to enable the mounting assembly 30 to fit over or fully or partially around the front sightpost of the M-16 (or other weapon) to which the assembly is mounted. Additionally, it enables the mounting bracket 30 to abut against the front sight post for greater stability.

The extension or tail portion 33 of the mounting assembly 30 is the portion upon which the aiming light assembly 10 is mounted. Preferably, an opening **33*a* (such as shown in FIG. 3) is provided to receive the fastening device 16 (FIG. 1) which is provided on the aiming light assembly 10. In a manner well known to one of ordinary skill in the art, the fastening device 16 may be received by the opening 33*a* to cause the aiming light to be operably fastened to the tail portion 33 of the mounting bracket 30. Due to the low profile of the aiming light assembly 10, the normal operation of the front and rear sight post is not hindered. In operation, the latch 37 (in cooperation with the handle 38**) enable the mounting bracket to be quickly and easily removed from the rifle, without tools.

Figure 4:
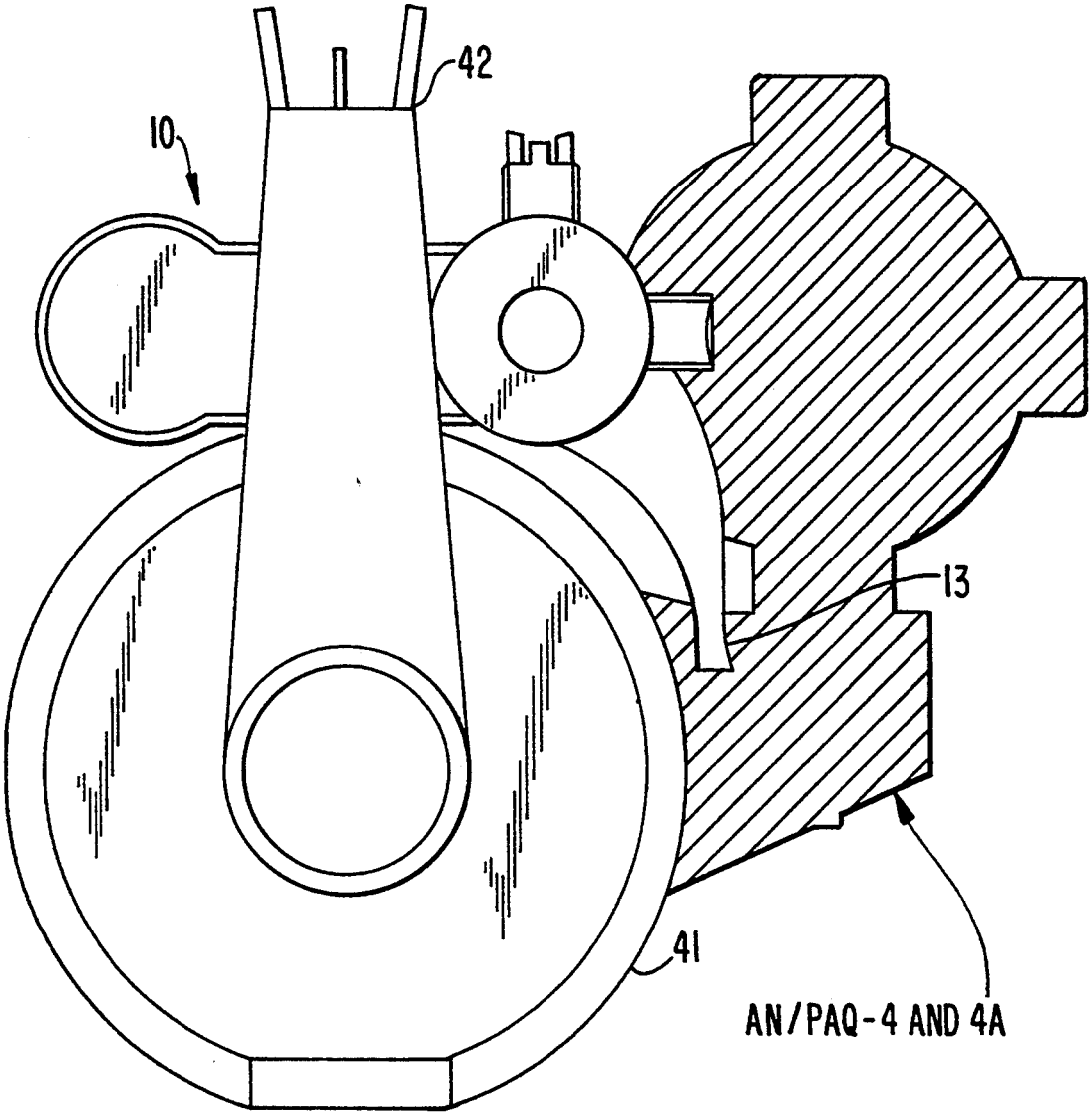
FIG. 4 is an illustration of the aiming light assembly attached to a weapon via the mounting bracket according to one embodiment of the present invention.

The aiming light assembly 10 as mounted to an M-16 rifle via mounting assembly 30 is shown in FIG. 4. In FIG. 4, the handguard 41 of the weapon is shown and generally defines the envelope of the weapon. The front sight post 42 is shown to extend above the aiming light assembly 10. The location of the aiming light assembly behind the front sight post, but abutting thereagainst, provides several advantages. One advantage is that the front sight post protects the aiming light assembly from unwanted impact. For example, if the weapon is dropped, the front sight post can prevent direct impact on the aiming light. Other types of unwanted impact are also prevented. Additionally, by having the mounting bracket abut against the front sight post, greater stability of the mounting bracket (and therefore the aiming light) is provided. Additionally, mounting in this manner avoids the need to have the mounting bracket wrap entirely around the barrel. This enables accessory devices to be easily located or mounted on the weapon. For example a bayonet or grenade launcher can be mounted to the underside of the weapon without interference from the mounting bracket 30. As also shown in FIG. 4, in phantom, the prior art AN/PAQ-4 and 4A projected out from the side of the weapon. This mounting configuration is less desirable since it increases the propensity for the rifle to be caught on foliage or the like especially if the weapon is being used in heavily wooded or foliaged areas. In order for the aiming light assembly to be mounted as shown in FIG. 4, for example, without interfering with the normal sighting, the aiming light assembly must be relatively compact. Various features described herein are used in combination to enable this compact design. One such feature (without limitation) is the boresighting adjustment mechanisms.

On an M-16 rifle with an M-203 grenade launcher attached, for example, the aiming light assembly 10 may be mounted on the side of the weapon (i.e. rotated 90° with respect to the previously described position) as shown for example in FIG. 2A. In this case, the cutout of the mounting bracket does not go over the front sight post, but the clamp is used to mount the assembly to the weapon. Similarly, as shown in FIG. 2B, for example, on an M-249 rifle, the aiming light can be mounted beside the handguard, with a mounting foot 102B, for example. A mounting foot can also be used to attach the aiming light to standard military brackets which already exist.

Figure 5:
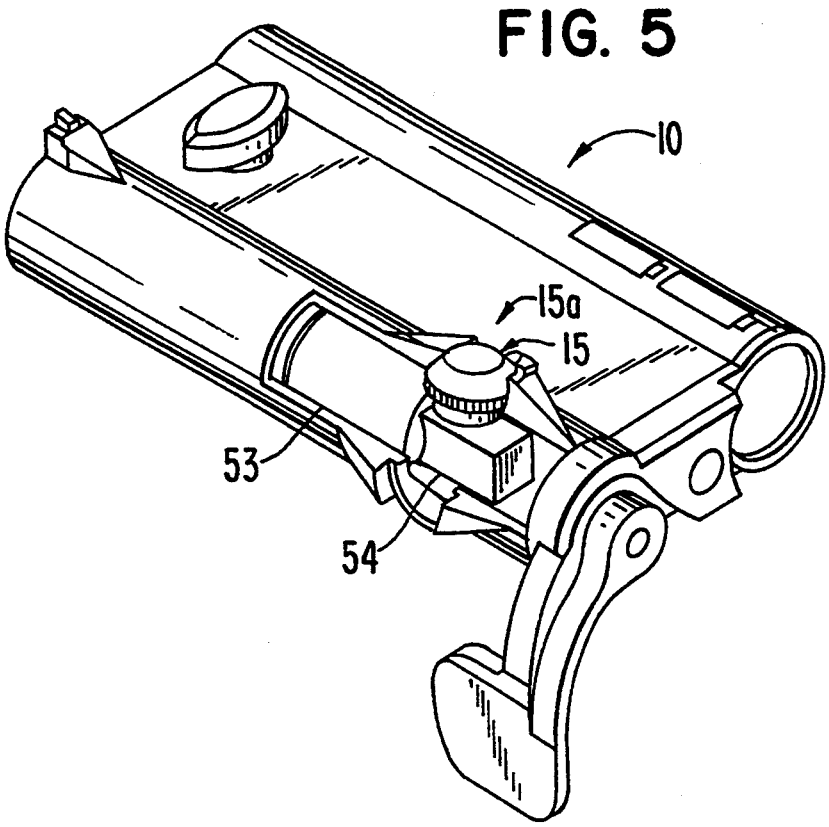
FIGS. 5 and 5A are partial cut away views of a boresight adjustment mechanism system and the aiming light assembly according to one embodiment of the present invention.
Figure 5A:
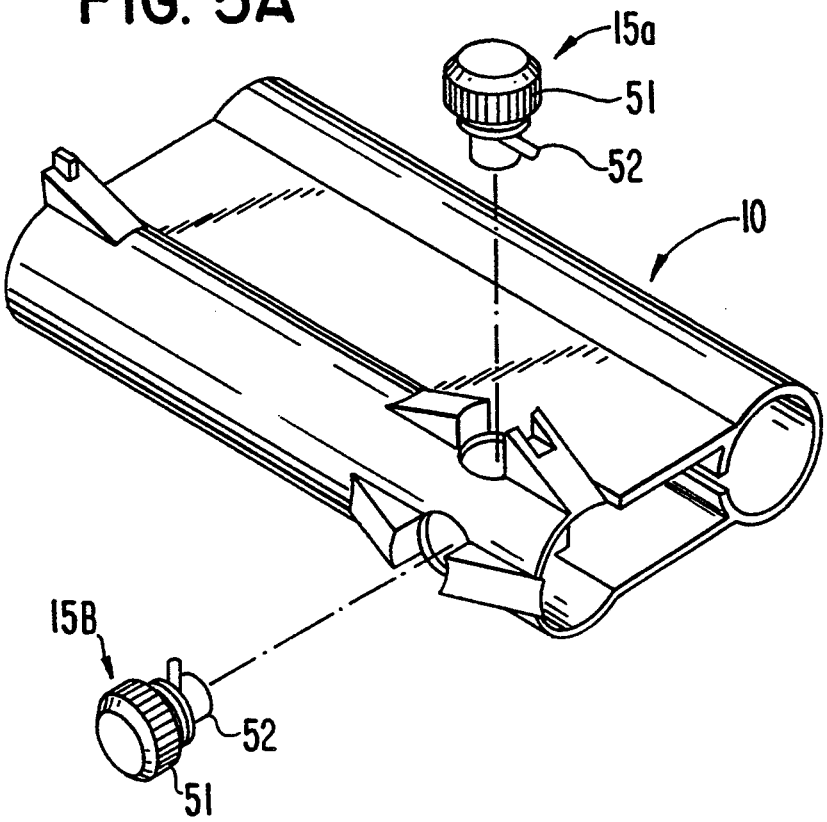

As is well known in the art, in order for an aiming light assembly to work accurately, it must be properly boresighted once it is mounted to the weapon. Due to the ballistic trajectory of ammunition fired from the weapon, the boresighting must typically be performed for a particular distance or range of distances. While boresighting, per se, is well known in the art, an aspect of the present invention is an improvement in the boresighting adjustment mechanisms of the aiming light assembly. The adjustment mechanisms, generally indicated as **15*a* and 15*b* in FIG. 1, are shown in greater detail in FIGS. 5 and 5A. As shown in FIGS. 5 and 5A, each of the boresighting adjustment mechanism includes and adjustment head 51 and a telescoping element 52 which cooperates with head 51. Within the assembly, the optical assembly comprises an optical housing wherein the light, e.g. a laser diode, and various optics are mounted. The telescoping portion 52 is used to steer or adjust the beam produced by the light assembly. According to a preferred embodiment, rotation of the head 51 causes the telescoping portion to act against a spring biased housing which may be either the electronics housing or the optical housing (in which the aiming light is located), which are preferably coupled together, to move the aiming light in one direction. Rotation of head 51 in the opposite direction causes movement of the optical and/or electronic assembly in the other direction. The adjustment heads 15*a* and 15*b*** operate in the same manner to enable independent vertical and horizontal adjustment. This adjustment arrangement enables a compact assembly which can be easily and effectively used. For example, this boresighting adjustment preferably takes place within the confines of a 0.800" diameter cylindrical housing portion (though the invention is not so limited) of the aiming light assembly. Preferably, the external adjustment heads protrude outside the assembly by only 0.2" to enable hand operation. Preferably, the adjuster heads are substantially only capable of rotational motion with respect to the aiming light assembly housing rather than being a screw type mechanism which moves in and out relative to the assembly. One advantage to this type of adjustment mechanism is that it prevents water, dirt or other unwanted particles from entering the assembly by facilitating a tight, water proof seal, preferably in conjunction with an O-ring. Those problems are most common in devices that use screw type (in/out) mechanisms to adjust the aiming beam position.

Preferably, the adjustment assemblies have audible or tactile detents to aid in boresighting.

Advantageously, the lens aperture through which the aiming beam is emitted may be reduced in size to approximately 0.25". This reduces the ability of an enemy to obtain reflection from the lens which is a common countermeasure.

Moreover, the aiming light assembly itself contains an optical sighting mechanism including at least two sights to assist in boresighting. These sights can simplify the boresighting procedures commonly employed, some of which require use of an additional aiming light.

The foregoing is a description of various features of the preferred embodiments of the present invention. It is to be understood that these features may be used alone or in combination. Various permutations of these features will be readily apparent to one of ordinary skill in the art. The invention may be used with various types of firearms including individual weapons (e.g., M-16 A1/A2/A3 rifles, M4, M4A1 carbines, M16/M203 rifles with grenade launcher, other types of rifles and handguns) and crew-served weapons (e.g., M-60 M-249's M249A1 and M2 machine guns.). To the extent not described above, it is to be understood that suitable optics can be used with the aiming light as will be readily apparent to one of ordinary skill in the art. According to a preferred embodiment, the aiming light is an infrared aiming light that is used in conjunction with night vision goggles in a known manner. In this embodiment, preferably the light is generated by an infrared laser diode. However, the various features described above are not limited to use with infrared light sources. Any suitable light may be used. With some types of weapons, alternative mountings may be necessary or desired. Preferably, the aiming light assembly has the ability to receive a mounting foot which enables it to be mounted to various types of known mountings, for example, an M60 mounting bracket. Various other modifications will be readily apparent to one of ordinary skill in the art. The invention is only limited by the claims appended hereto.

We claim:

1. An aiming light assembly which is selectively attachable to a weapon by a mounting bracket comprising:

a housing;

an aiming light located within said housing;

a switch which is operable to selectively switch said aiming light on and off;

wherein said switch is operable in a plurality of positions including a first position which corresponds to a first off position, a second position which corresponds to a first momentary on position, a third position which corresponds to a steady on position, a fourth position which corresponds to a second momentary on position and a fifth position which corresponds to a second off position.

2. The aiming light assembly of claim 1 wherein said aiming light comprises an infrared aiming light.

3. The aiming light assembly of claim 1, wherein said housing comprises a jack for a remote switch.

4. The aiming light assembly of claim 1, further comprising a jack; a remote switch located remotely from said housing and selectively operable to control said light; and a connector having a first end which is selectively engageable with said jack and a second end which is connected to said remote switch.

5. The aiming light assembly of claim 1, wherein said mounting bracket comprises a first portion which is attachable to said barrel; a second portion which enables the bracket to fit over the front sight post; and a third portion upon which said aiming light assembly can be mounted.

6. The aiming light assembly of claim 1 further comprising means for adjusting the direction of an aiming beam produced by said aiming light.

* * * * *